United States Patent [19]

Holcombe

[11] Patent Number: 4,750,310

[45] Date of Patent: Jun. 14, 1988

[54] STOREFRONT FRAMING SYSTEM

[75] Inventor: Robert D. Holcombe, Lilburn, Ga.

[73] Assignee: Kawneer Company, Inc., Norcross, Ga.

[21] Appl. No.: 935,045

[22] Filed: Nov. 26, 1986

[51] Int. Cl.[4] ..... E04C 3/30

[52] U.S. Cl. ..... 52/731; 52/235; 52/397; 52/710; 403/348; 411/84

[58] Field of Search ..... 403/348, 405.1, 407.1; 49/505, DIG. 1; 52/235, 395, 398, 466, 468, 482, 489, 582, 584, 710, 772, 775, 785, 717, 718, 397, 731; 24/297, 336, 590, 621; 411/84, 85, 902

[56] References Cited

U.S. PATENT DOCUMENTS

| | | | |
|---|---|---|---|
| 1,849,811 | 3/1932 | Smiley, Jr. | 52/696 |
| 2,345,650 | 4/1944 | Attwood | 403/21 |
| 2,395,650 | 2/1946 | Allen | 411/84 |
| 2,812,559 | 11/1957 | McCarran | 52/717 |
| 2,852,828 | 9/1958 | Hamman | 24/291 |
| 3,053,353 | 9/1962 | Miller | 52/477 |
| 3,304,686 | 2/1967 | Munse | 52/718 |
| 3,367,077 | 2/1968 | Johnston | 52/464 |
| 3,380,210 | 4/1968 | Neal | 52/235 |
| 3,553,891 | 1/1971 | Casebolt et al. | 49/505 |
| 3,589,525 | 6/1971 | Allen | 211/162 |
| 4,117,640 | 10/1978 | Vanderstar | 52/398 |
| 4,315,393 | 2/1982 | Schack et al. | 52/710 |
| 4,428,171 | 1/1984 | Harbin | 52/398 |
| 4,532,744 | 8/1985 | Beneze et al. | 52/222 |
| 4,572,694 | 2/1986 | Hoeksema | 403/187 |
| 4,575,295 | 3/1986 | Rebentisch | 411/85 |

FOREIGN PATENT DOCUMENTS

| | | | |
|---|---|---|---|
| 250235 | 9/1926 | Italy | 52/772 |

*Primary Examiner*—John E. Murtagh
*Assistant Examiner*—Andrew Joseph Rudy
*Attorney, Agent, or Firm*—Jones, Askew & Lunsford

[57] ABSTRACT

A thermally insulated framing system for storefronts and the like includes inner and outer framing elements connected by a combination twist-in/snap-on insulating clip. The base of the clip is twist-lockable into a locking channel on one frame member, and compressible ridges on the lower face of the base wedge the base securely within the locking channel. A pair of legs at the other end of the clip are snap-fittable onto a locking flange formed on the other frame member. By providing a plurality of pairs of retaining grooves on the locking flange, the clip can be locked into any one of a plurality of locking positions relative to the locking flange, enabling the framing system to accommodate glazing panels of different thicknesses.

23 Claims, 4 Drawing Sheets

STOREFRONT FRAMING SYSTEM

TECHNICAL FIELD

The present invention relates generally to a thermal barrier system for panel installations for storefronts and the like, and relates more specifically to a framing system having inner and outer frame elements connected by a thermally non-conductive glazing clip.

BACKGROUND OF THE INVENTION

Thermal barrier systems for panel installations for store front framing systems and the like are well-known. Typically, such a framing system includes inner and outer metal frame elements connected by a thermally insulating coupler member, with channels being formed on the frame elements to receive the edges of infill panels.

Numerous methods are known for securing the thermally non-conductive connector to the inner and outer frame elements. In one type of connection known as a "twist-in" connection, the connector has a base which is rotatable into lockable engagement with a locking channel defined in one of the frame elements. In a second type of connection known as a "snap-in" connection, the connector has a pair of resilient legs which snap outwardly to bring flanges formed on their outer edges into locking engagement with a pair of opposing slots defined on one of the metal elements. With a third type of connection known as a "snap-on" connection, a pair of resilient legs having flanges formed on mutually facing portions receive a locking flange therebetween and snap inwardly into grooves formed on the lateral edges of the locking flange.

An example of a prior art thermal barrier system for store front framing installations and the like is found in U.S. Pat. No. 4,117,640. Inner and outer metal elements receive the edges of infill panels therebetween and are connected by a thermally non-conductive coupler member. The coupler member has a twist-on connector formed at its base which is rotatable into locking engagement with a pair of slots defined on the inner metal element. The coupler member further has a snap-in connector formed at its opposite end which snaps into locking engagement with a pair of slots defined on the mutually facing portion of the outer metal element.

Thermal barrier systems such as that disclosed in the aforementioned U.S. Pat. No. 4,117,640 suffer a number of disadvantages. First, the legs of the coupler member which are twist-lockable into engagement with the locking channel are dependent upon a snug fit and the resiliency of the coupler material to remain locked in place. Such a design does not afford accommodation for manufacturing tolerances in either the locking channel or the coupler member. Further, exposure to the elements over a period of time may cause the coupler member to lose some of its resiliency. Accordingly, extrusion tolerances or a loss of resiliency can permit the coupler member to slide within the locking channel.

The sliding of the coupler member within the locking channel can have a number of adverse consequences. First, if the twist-in clip cannot be fixed securely in place, it will be impossible to preinstall the clips, and the clips will have to be installed in the locking channel at the job site. The inability to preinstall the clips will increase the labor costs incurred in installing the clips, since clips installed by skilled labor at the job site will incur a higher labor rate than would be incurred by shop labor or by an automated or semi-automated installation procedure which would be possible only in the shop. Further, a worker installing clips in the friendly environment of a warm shop will be able to install the clips faster and more accurately than a worker battling inclement weather at the job site, possibly wearing gloves to protect against the elements.

Thus, there is a need to provide an insulating glazing clip which can be preinstalled onto one of the frame members prior to delivery to the job site.

Furthermore, clips which are not securely anchored within the locking channel can still slide within the channel even after installation. Wind loads on the storefront panels and temperature fluctuations whereby the outside frame member thermally expands and contracts more drastically than the interior frame member can create forces on the clip which would tend to displace it if it is not securely anchored. Particularly in vertical frame members, the clips can slide toward the lower end of the locking channel, permitting the upper end of the frame member to separate.

Accordingly, there is a need to provide a twist-in coupler member which can be securely anchored within its locking channel.

A further disadvantage of the storefront framing system disclosed in the aforementioned U.S. Pat. No. 4,117,640 is the inability of a single clip to accommodate glazing panels of different thicknesses. For example, if it is desired to increase the spaced-apart relation between the frame members to accommodate a one inch thick glazing panel, rather than a one-quarter inch panel, it is necessary to provide a coupler member which is three-quarters of an inch longer. Not only is it an added effort and expense to maintain an inventory of a variety of different lengths of clips, but also the potential is introduced for accidentally installing the wrong clip for a particular application.

Accordingly, there is a need to provide a storefront framing system wherein a single clip can accommodate infill panels of different thicknesses.

SUMMARY OF THE INVENTION

As will be seen, the present invention overcomes these and other problems associated with the prior art thermal barrier systems for storefront framing systems and the like. Stated generally, the present invention comprises an improved framing system comprising a gutter or inner frame member, a face or outer frame member, and a thermally non-conductive clip connecting the two frame members. The clip can be preinstalled on the face member at the factory, and then snapped onto the gutter member at the job site for speed and ease of installation. A plurality of locking positions of the clip relative to the gutter member are provided such that a single clip can accommodate either one inch or one-quarter inch thick infill panels.

Stated somewhat more specifically, the framing system of the present invention comprises a face member having a locking channel formed on its inner face, a gutter member having an outwardly projecting locking flange, and a combination twist-in/snap-on clip whose base is rotatable into locking engagement with the face member locking channel and whose other end is snap-fittable onto the locking flange of the gutter member. A plurality of compression ridges formed on the twist-in base lock the clip securely within the face member locking channel and prevent the clip from sliding from within the channel. Accordingly, twist-locking of the clip onto the face member can be accomplished, if desired, at the factory for ease and speed of installation, and the clips will remain securely locked in place without sliding during shipment and installation. At the other end of the clip, the snap-on legs can engage either of the inner or outer pairs of locking grooves formed on the locking flange, such that the clip can accommodate either one inch or one-quarter inch thick infill panels by simply advancing the clip to the appropriate position on the locking flange.

Stated more specifically, the framing system of the present invention includes a face member having a receiving channel formed on one face thereof. A gutter member is disposed in parallel spaced-apart relation to the face member such that the edges of infill panels can be received between the face and gutter members. The gutter member further has a locking flange formed thereon, the locking flange having opposing lateral faces with inner and outer retaining grooves formed thereon. A clip has an elongated base at one end thereof dimensioned such that when the elongate axis of the base is aligned with the elongate axis of the channel on the face member, the base is receivable into the channel and twist-lockable therein. Compressible ridges formed on the lower face of the base are crushed by the walls of the locking channel as the clip is twist-locked, the crushed mass of the compressed ridges providing a "shimming" action which securely wedges the clip within the locking channel. At the opposite end of the clip, an opposing pair of resilient legs having tabs on mutually facing portions thereof receive the locking flange therebetween, the tabs engaging one of the sets of retaining grooves formed on the opposing faces of the retaining element. By snap-fitting the legs into either of the two sets of grooves, the spaced-apart relation between the face and gutter members can be controlled to accommodate the edges of infill panels of different thicknesses.

Thus, it is an object of the present invention to provide an improved thermally insulted framing system for storefronts and the like.

It is a further object of the present invention to provide a twist-on glazing clip which can accomodate manufacturing tolerances in the clip base or the frame member locking channel, without adversely impacting the locking relation between the clip and frame member.

It is another object of the present invention to provide a framing system wherein the insulating clip can be pre-installed onto one of the framing members.

It is yet another object of the present invention to provide a framing system wherein a single glazing clip can accommodate infill panels of different thicknesses.

Other objects, features, and advantages of the present invention will become apparent upon reading the following specifications when taken in conjunction with the drawings and the appended claims.

DETAILED DESCRIPTION OF THE DISCLOSED EMBODIMENT

Figure 1:
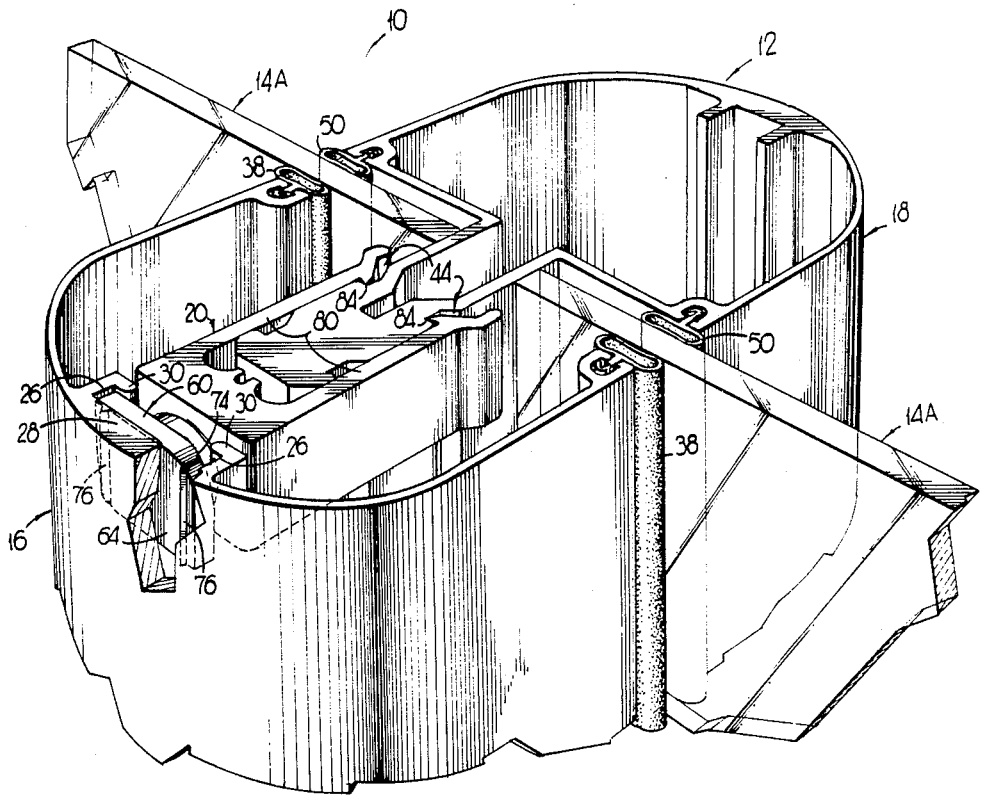
FIG. 1 is a perspective view of an assembled storefront framing system including a face member, a gutter member, and a glazing clip, according to the present invention.

Referring now in more detail to the drawing, in which like numerals indicate like elements throughout the several views, FIG. 1 shows a storefront framing system 10 including a frame member 12 for mounting infill panels 14. The frame member 12 includes a face or outer member 16 and a gutter or inner member 18 connected by a glazing clip or coupler member 20. The face member 16 and gutter member 18 are formed as extrusions of indeterminate length from aluminum or other appropriate material.

Figure 2:
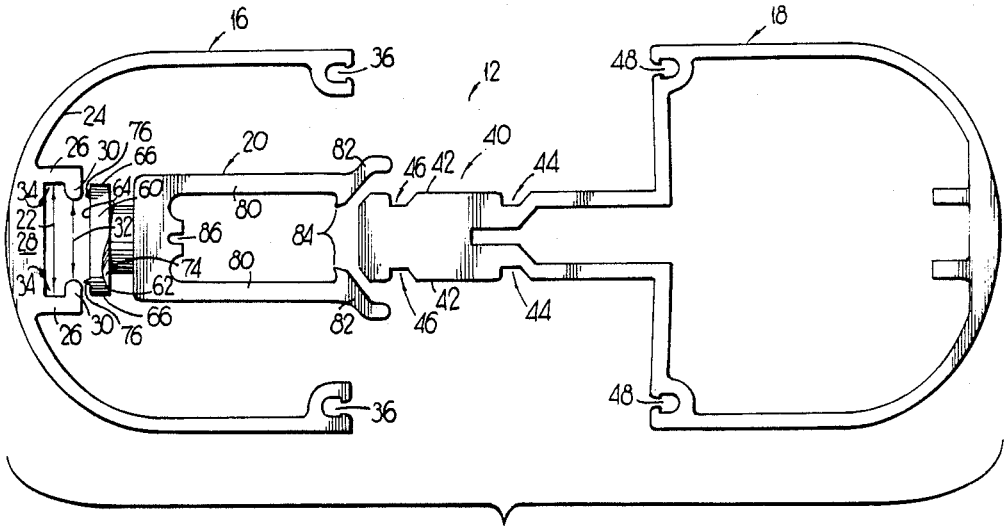
FIG. 2 is an exploded end view of the face member, gutter member, and glazing clip of FIG. 1.
Figure 3:
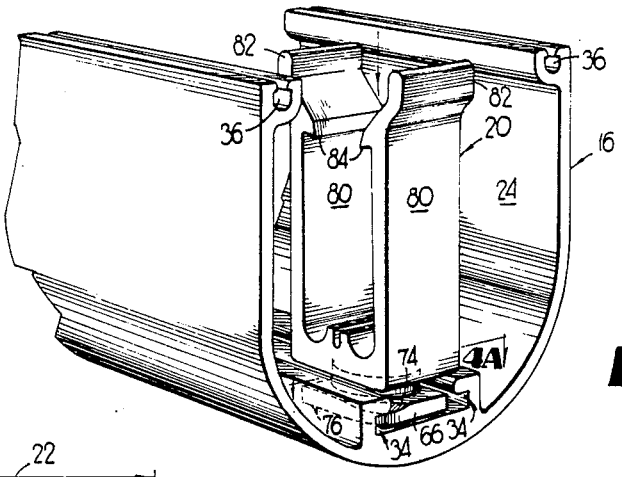
FIG. 3 is a perspective view of the glazing clip of FIG. 1 partially assembled onto the face member.

The face member 16 has a locking channel or reglet 22 formed on its inner surface 24. As seen in FIG. 2, the locking channel 22 is defined by opposing side channel walls 26, a bottom channel wall 28 connecting the lower ends of the side walls 26, and upper channel walls 30 extending inwardly from the upper ends of the side walls 26 with a groove 32 running therebetween. It will be appreciated that the channel walls 26, 28, and 30 define opposing slots 34.

The face member 16 further includes raceways 36 (FIG. 2) formed at its upper ends for receiving the edges of conventional sealing gaskets 38, as shown in FIGS. 1 and 5–7.

The gutter member 18 has a locking flange 40 projecting from one face thereof. The locking flange 40 includes lateral walls 42, each lateral wall having upper longitudinal locking grooves 44 and lower longitudinal locking grooves 46 formed thereon. The upper ends of the upper and lower locking grooves are beveled, and the upper and lower grooves are axially spaced apart by three-quarters of an inch, for reasons which will become apparent. The gutter member 18 further has raceways 48 (FIG. 2) formed thereon for receiving the edges of conventional sealing gaskets 50, as shown in FIGS. 1 and 5-7.

The glazing clip 20 is formed from a thermally non-conductive material such as plastic. The clip has a base 60 formed at its lower end. The base 60 is essentially rectangular in shape and includes an upper face 62, a lower face 64, opposing lateral walls 66, and opposing longitudinal walls 68. The lateral dimensions of the base are slightly smaller than the width of the groove 32 between the upper walls 30 of the locking channel 22, and the longitudinal dimension of the base is approximately equal to the distance between the side walls 26 of the locking channel. Two opposing corners 70 of the base 60 are squared, and the other two opposing corners 72 of the base are rounded. The upper edges 74 of the rounded corners are beveled. On the lower face 64 of the base 60 and parallel to the lateral axis of the base are a pair of compressible ridges 76.

At the upper end of the clip are a pair of springable snap legs 80. Downwardly and inwardly beveled lead-ins 82 are formed at the upper ends of the snap legs 80, the lower edges of the lead-ins 82 defining opposing flanges 84 on the inner surface of the snap legs 80. A tool slot 86 dimensioned to receive the tip of a conventional flathead screwdriver is formed at the juncture between the snap legs 80.

Figure 4A:
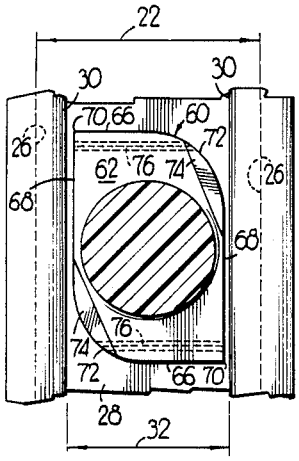
FIGS. 4 A–C are top cut-away views taken along line 4—4 of FIG. 3, showing how the glazing clip is twist-locked onto the face member.
Figure 4B:
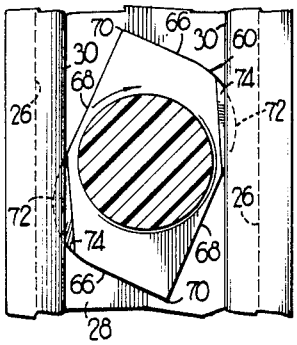

To assemble a storefront framing system according to the present invention, the glazing clips 20 are installed in the locking channel 22 on the inner surface 24 of the face member 16 at approximately twelve inch intervals. To install the clip 20 onto the face member 16, the clip is oriented with the longitudinal axis of its base 60 parallel to the longitudinal axis of the locking channel 22, and the base of the clip is inserted through the groove 32 between the upper channel walls 30 and into the locking channel 22. With the base 60 of the clip 20 thus inserted into the locking channel as shown in FIG. 4A, the clip is rotated in a clockwise direction as shown in FIG. 4B. As the beveled edges 74 of the rounded corners 72 engage the upper walls 30 of the locking channel 22, the base 60 of the clip 20 is wedged downwardly within the locking channel, compressing the ridges 76 on the lower face 64 of the base against the lower channel walls 28. The clip is further rotated in a clockwise direction until it reaches the position shown in FIG. 4C, at which point the lateral walls 66 of the base 60 engage the side channel walls 26 of the locking channel 22, preventing further rotation.

With the base 60 of the clip 20 thus twist-locked into engagement with the locking channel 22, the compressed mass of the ridges 76 provides a shimming effect which wedges the upper face 62 of the base tightly against the upper walls 30 of the locking channel and locks the clip securely within the channel. When the extrusion tolerances result in a locking channel which is slightly shallower than the specification calls for, the ridges 76 will be compressed to a greater extent, the beveled edges 74 of the base cammingly engaging the upper channel walls 30 to facilitate the compression of the ridges. Conversely, when extrusion tolerances result in a locking channel 22 which is somewhat deeper than specification, the ridges 76 will not be compressed as greatly, but will still maintain the upper face 62 of the base firmly in engagement with the upper channel walls 30 of the locking channel 22.

Figure 4C:
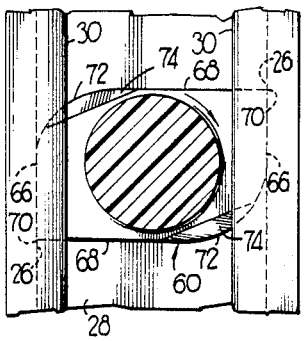

It will be appreciated that the clip 20 can be rotated only in a clockwise direction as seen in FIGS. 4A–4C, since any attempt to rotate the clip in a counterclockwise direction will bring the squared corners 70 of the base 60 into contact with the side channel walls 26, preventing further rotation. However, when the clip is rotated in a clockwise direction, the rounded corners 72 of the base 60 permit the clip to turn until the lateral walls 66 of the base are brought into engagement with the side walls 26 of the locking channel 22.

If desired, a flathead screwdriver can be inserted between the snap legs 80 of the clip 20 and into the tool slot 86, the screwdriver being used to rotate the clip to facilitate the twist-locking of the base of the clip into the locking channel 22.

Figure 5:
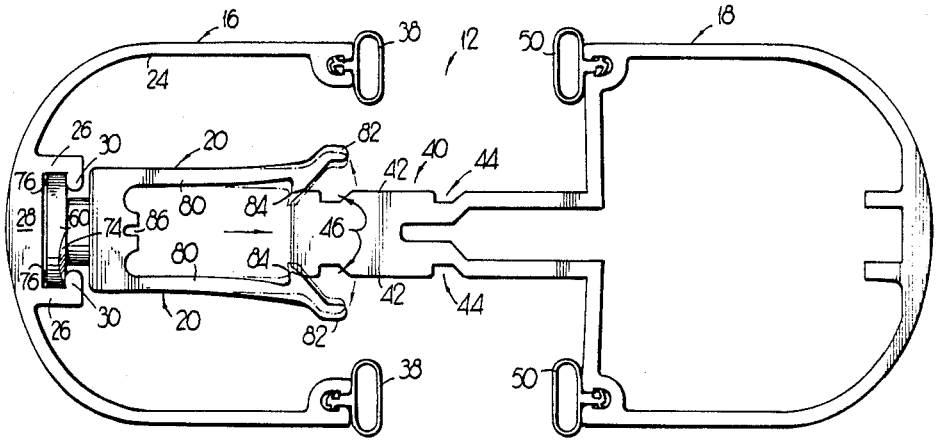
FIG. 5 is an end view of the assembled glazing clip and face member being installed onto the gutter member.

With the clip 20 twist-locked into the locking channel 22 on the inner surface 24 of the face member 16, as shown in FIG. 5, the clip/face assembly is then snapped onto the gutter member 18. As the upper ends of the snap legs 80 of the clip 20 are brought into contact with the locking flange 40 of the gutter member 18, the lead-ins 82 wedge the snap legs 80 outwardly. As the flanges 84 on the inner surface of the snap legs 80 engage the lower grooves 46 formed on the lateral walls 42 of the locking flange 40, the legs 80 snap inwardly, locking the clip securely onto the locking flange. If the clip is pushed further onto the locking flange, the lead-ins 82 on the upper ends of the snap legs 80 engage the beveled upper ends of the lower grooves 46 and wedge the legs outwardly, once again, disengaging the flanges 84 from the lower grooves. As the clip is pushed further onto the locking flange 40, the flanges 84 engage the upper grooves 44 of the locking flange.

With the framing member 12 thus assembled, the clips 20 hold the face 16 and gutter 18 in parallel, spaced-apart relation and thermally insulate the face and gutter from one another.

Figure 6:
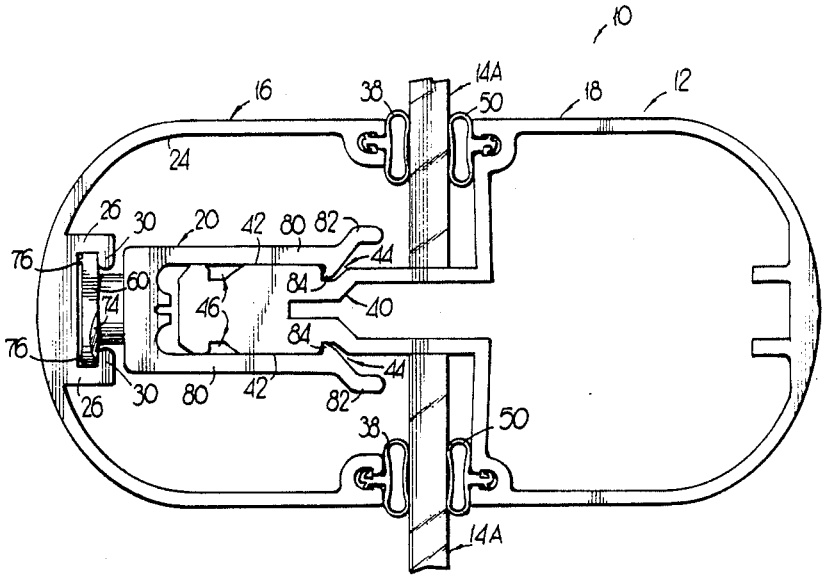
FIG. 6 is an end view of the storefront framing system of FIG. 1 with one-quarter inch infill panels installed.
Figure 7:
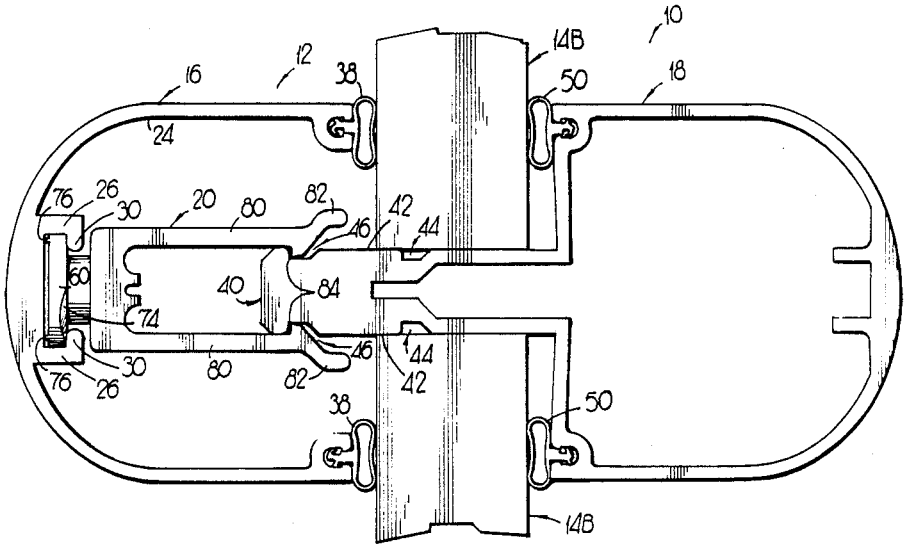
FIG. 7 is an end view of the storefront framing system of FIG. 1 with one inch infill panels installed.

An important feature of the present invention is the provision of a plurality of locking positions of the clip 20 with respect to the locking flange 40. The advantage of this feature is perhaps best appreciated with reference to FIGS. 6 and 7. As shown in FIG. 6, with the flanges 84 of the snap legs 80 engaged in the upper longitudinal locking grooves 44 on the lateral walls 42 of the locking flange 40, the spaced-apart relation between the face member 16 and the gutter member 18 accommodates a one-quarter inch infill panel 14. However, as shown in FIG. 7, by engaging the flanges 84 in the lower longitudinal locking grooves 46, which are axially spaced apart from the upper locking grooves 44 by three-quarters of an inch, the spaced-apart relation between the face 16 and gutter 18 is increased by three-quarters of an inch, permitting the frame member 12 to accommodate a one inch thick infill panel 14A. Thus, the same clip can accommodate infill panels of different thicknesses.

Another important feature of the present invention is the provision of compressible ridges 76 formed on the lower face 64 of the base 60. Because the compressible ridges shim the base of the clip to wedge it securely within the locking channel, the clip remains firmly in place and will not slide within the channel. This feature provides a number of advantages, among them being the ability to pre-install the clip prior to delivering the face member to the job site. Pre-installation can result in lower labor costs and ease of installation, since skilled labor is not required to install the clip, and since the controlled environment of the shop is more conductive to a speedy and accurate assembly of the clips into the locking channel. Even after the framing system has been assembled, the improved clip continues to provide advantages, since wind loads and thermal expansion and contraction cannot cause the securely-locked clip to slide to the bottom of the locking channel. Thus, the integrity of the assembly is maintained.

Figure 8:
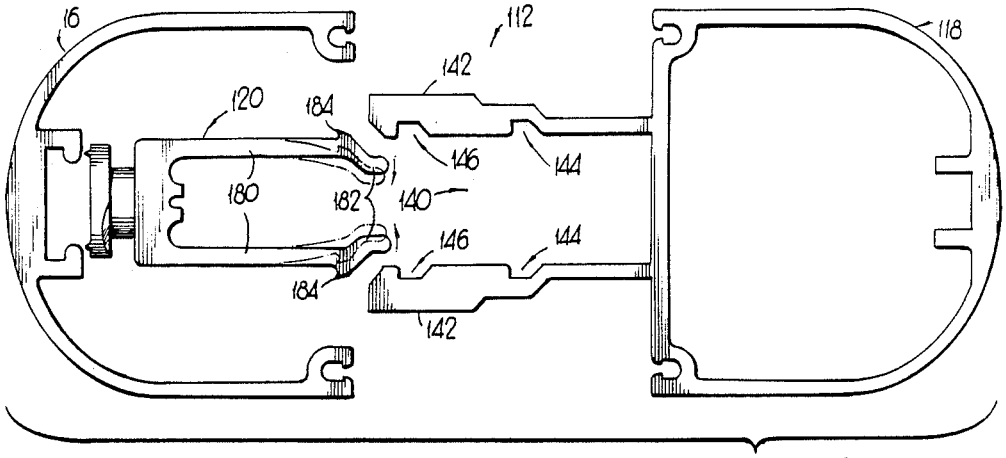
FIG. 8 is an exploded end view of a storefront framing system according to an alternate embodiment of the present invention.
Figure 9:
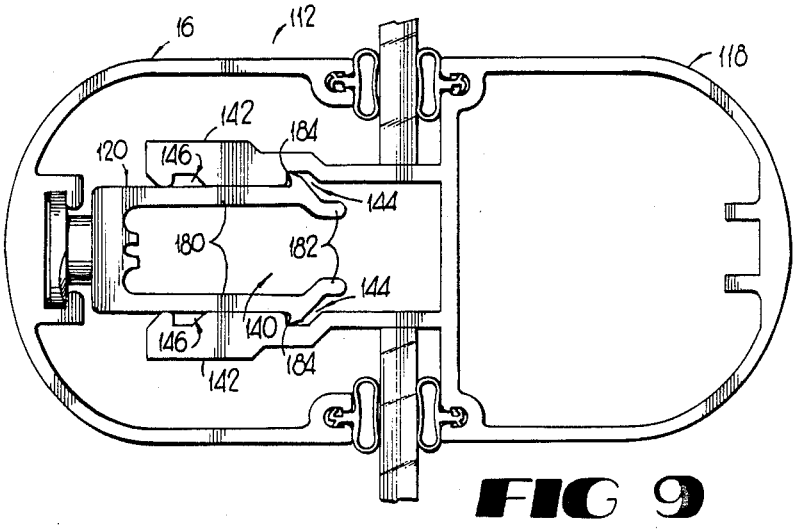
FIG. 9 is an end view of the alternate embodiment of FIG. 8 assembled for one-quarter inch infill panels.
Figure 10:
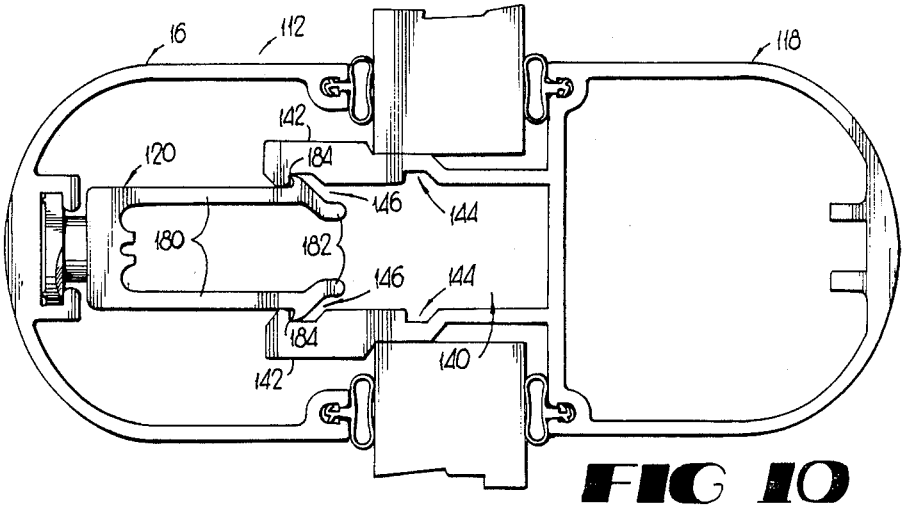
FIG. 10 is an end view of the alternate embodiment of FIG. 8 assembled for one inch infill panels.

FIGS. 8–10 show an alternate embodiment of a frame member 112 including a face member 16, a gutter member 118, and a clip 120. The gutter member 120 has a locking channel 140 defined by parallel, spaced-apart lateral walls 142. Upper longitudinal locking grooves 144 and lower longitudinal locking grooves 146 are formed on mutually facing portions of the lateral walls 142 defining the locking channel 140.

The clip 120 includes snap legs 180 having lead-ins 182 formed at their upper ends. The lead-ins 182 are beveled downwardly and outwardly, and flanges 184 are formed on the outer faces of the snap legs 180.

The clip 120 is installed on the face member 16 in the manner hereinabove described for the frame member 12. With the clip assembled onto the face member 16, the clip/face assembly is installed onto the gutter member 118. As the lead-ins 182 on the upper end of the snap legs 180 of the clip 120 engage the lower ends of the walls 142 defining the locking channel 140 on the gutter member 118, the snap legs are cammed inwardly. As the clip 120 is pushed further into the locking channel 140, the flanges 184 on the outer edges of the snap legs 180 engage the lower locking grooves 146 on the inside of the lateral walls 142 defining the locking channel 140. The legs 180 snap outwardly, maintaining the flanges 184 securely within the locking grooves. If the clip 120 is advanced further into the locking channel 140, the lead-ins 182 on the upper ends of the snap legs 180 bear against the beveled upper ends of the lower locking grooves 146 and wedge the snap legs 180 inwardly. As the clip is advanced further into the locking channel, the flanges 184 engage the upper locking grooves 144, whereupon the legs 180 again snap outwardly to maintain the flanges securely in engagement with the locking grooves.

In the same manner that the frame member 12 provides a plurality of locking positions of the clip 20 with respect to the locking flange 40, the frame member 112 of the alternate embodiment also provides a plurality of locking positions of the clip 120 with respect to the locking channel 140. Thus, a single clip 20 can accommodate infill panels of one-quarter inch thickness, as shown in FIG. 9, by engaging the flanges 184 with the upper locking grooves 144 of the locking channel 140. Or, it can accommodate a one inch thick infill panel, as shown in FIG. 10, by engaging the flanges 184 of the snap legs 180 with the lower locking grooves 146 of the locking channel 140.

While the disclosed embodiments have been illustrated with respect to a vertical mullion, the glazing clip with compressible ridges and the gutter member which provides a plurality of locking positions to control the spaced-apart relation between the face member and the gutter are equally well-suited for horizontal muntins, headers, sills, and corner members.

It will be understood that terms such as "upper" and "lower" are used herein for convenience of description, and are not intended to limit the invention to a particular orientation.

Finally, it will be understood that the preferred embodiment of the present invention has been disclosed by way of example, and that other modifications may occur to those skilled in the art without departing from the scope and spirit of the appended claims.

What is claimed is:

1. A framing system for storefronts and the like, comprising:

a first frame member having a locking channel formed thereon;

a second frame member in parallel spaced-apart relation to said first frame member;

a coupler member having a base at one end thereof, said base being rotatable within said locking channel of said first frame member to form a locking engagement with said locking channel, said coupler member further having a plurality of compressible ridges formed on said base which are compressed as said base is rotated within said locking channel such that said compressed ridges wedgingly secure said base of said coupler member within said locking channel; and means for attaching the other end of said coupler member to said second frame member, whereby said coupler member secures said first and second frame members together in parallel spaced-apart relation.

2. The framing system of claim 1, wherein said second frame member has a locking flange projecting therefrom with grooves formed on lateral edges thereof, and wherein said means for attaching the other end of said coupler member to said second frame member comprises a pair of resilient legs formed at said other end of said coupler member and having flanges formed on mutually facing portions thereof, said locking flange being received between said pair of resilient legs such that said resilient legs snap inwardly to engage said flanges on said legs of said coupler member with said grooves on said lateral edges of said locking flange.

3. The framing system of claim 2, wherein said other end of said coupler member has a plurality of locking positions with respect to said locking flange for controlling the spaced-apart relation between said first and second frame members.

4. The framing system of claim 1, wherein said second frame member has opposing spaced-apart walls defining a locking channel formed thereon with opposing slots formed on mutually facing portions of said walls defining said locking channel and wherein said means for attaching the other end of said coupler member to said second frame member comprises a pair of resilient legs formed at said other end of said coupler member and having flanges formed on outwardly facing portions thereof, said pair of resilient legs being received within said locking channel such that said resilient legs snap outwardly to engage said flanges on said legs of said coupler member with said opposing slots on said mutually facing portions of said walls defining said locking channel.

5. The framing system of claim 4, wherein said other end of said coupler member has a plurality of locking positions with respect to said locking channel for controlling the spaced-apart relation between said first and second frame members.

6. A coupler member for engaging an elongated receiving channel having opposing side walls, bottom walls extending inwardly from the lower ends of said side walls, and upper walls extending inwardly from the upper ends of said side walls with a groove running therebetween, said channel walls defining opposing slots, said coupler member comprising:

an elongated base having upper and lower faces and dimensioned when the elongate axis of said base is aligned with said groove between said upper walls to be received through said groove and into said channel;

compressible ridges formed on one of said upper or lower faces of said base such that when said base is received within said channel and rotated to position said elongate axis of said base transversely to said channel, said ridges bear against the contiguous upper or lower channel walls and force the opposite face of said base snugly against the other of said upper or lower channel walls, compressing said ridges and wedging said base within said channel; and a body extending upwardly from said base such that when said base is wedged within said channel, said body extends through said groove between said upper channel walls and above said upper channel walls so as to project exteriorly of said channel.

7. The coupler member of claim 6, wherein said elongated base is substantially rectangular.

8. The coupler member of claim 7, wherein two opposing corners of said rectangular base are rounded to facilitate the rotation of said base within said channel.

9. The coupler member of claim 8, wherein the other two opposing corners of said rectangular base are squared, such that when said base is received within said channel said squared corners engage said side walls and permit said base to rotate within said channel in only one direction, and such that when said base is rotated one-quarter turn in said one direction said squared corners engage said side walls to prevent said base from rotating further than one-quarter turn.

10. The coupler member of claim 7, wherein two opposing corners of said rectangular base are beveled on one of said upper or lower faces such that as said base is rotated within said channel said beveled corners wedgingly engage the contiguous upper or lower channel walls to facilitate the compression of said ridges.

11. The coupler member of claim 8, wherein said two rounded corners of said rectangular base are beveled on one of said upper or lower faces such that as said base is rotated within said channel said beveled corners wedgingly engage the corresponding upper or lower channel walls to facilitate the compression of said ridges.

12. A framing system for storefronts and the like, comprising:

a first frame member having a receiving channel formed on one face thereof, said channel having opposing side walls having upper and lower ends, bottom walls extending inwardly from said lower ends of said side walls, and upper walls extending inwardly from said upper ends of said side walls with a groove running therebetween, said channel walls defining opposing slots;

a second frame member having a locking flange projecting from one face thereof, said locking flange having opposing lateral faces defining retainer grooves therein; and a coupler member, comprising:

an elongated base at one end thereof, said base having upper and lower faces and an elongate axis, said base being dimensioned when said elongate axis of said base is aligned with said groove between said upper walls of said first frame member to be received through said groove and into said channel, said base further being dimensioned such that when said coupler member is inserted into said channel and twisted to position said elongate axis of said base transversely to said channel, said base engages said opposing slots of said channel to lock said coupler member within said channel;

compressible ridges formed on one of said upper or lower faces of said base such that when said base is received within said channel in said first frame member and twisted to position said elongate axis of said base transversely to said channel, said ridges bear against the corresponding upper or lower channel walls and force the opposite face of said base snugly against the other of said upper or lower channel walls, compressing said ridges and wedging said base within said channel;

a pair of resilient legs projecting upwardly from said base in spaced-apart relation for receiving said locking flange therebetween;

flanges formed on mutually facing portions of said legs for engaging said retainer grooves on said opposing lateral faces of said locking flange, whereby when said base of said coupler member is secured within said channel of said first member, said legs of said coupler member engage said retainer grooves of said locking flange on said second frame member to secure said frame members together in spaced-apart relation.

13. The framing system of claim 12, wherein said retainer grooves comprise a first set of retainer grooves, and wherein said opposing lateral faces of said locking flange of said second frame member further define a second set of retainer grooves in parallel, spaced-apart relation to said first set of retainer grooves, whereby said flanges on said legs can engage either of said sets of retainer grooves to control the spaced-apart relation between said frame members.

14. The framing system of claim 12, wherein said elongated base of said coupler member is substantially rectangular.

15. The framing system of claim 14, wherein two opposing corners of said rectangular base of said coupler member are rounded to facilitate the rotation of said base within said channel as said coupler member is twisted.

16. The framing system of claim 15, wherein the other two opposing corners of said rectangular base are squared, such that when said base is received within said channel said squared corners engage said side walls and permit said base to rotate within said channel in only one direction, and such that when said coupler member is twisted one-quarter turn in said one direction said squared corners of said base engage said side walls to prevent said coupler member from being twisted further than one-quarter turn.

17. The coupler member of claim 14, wherein two opposing corners of said rectangular base are beveled on one of said upper or lower faces such that as said coupler member is twisted to rotate said base within said channel said beveled corners wedgingly engage the contiguous upper or lower channel walls to facilitate the compression of said ridges.

18. The coupler member of claim 15, wherein said two rounded corners of said rectangular base are beveled on one of said upper or lower faces such that as said coupler member is twisted to rotate said base within said channel said beveled corners wedgingly engage the corresponding upper or lower channel walls to facilitate the compression of said ridges.

19. The framing system of claim 12, wherein said ends of said legs of said coupler member opposite said base comprise wedging surfaces such that as said locking flange of said second frame member is received between said legs said wedging surfaces engage the adjacent edges of said locking flange and force said legs outwardly to either side of said locking flange, said legs resiling inwardly as said flanges engage said retainer grooves, whereby said flanges are maintained firmly within said grooves.

20. A coupler member for connecting first and second adjacent frame members, the first of said frame members including a receiving channel formed on a portion facing the second frame member and having opposing side walls having upper and lower ends, bottom walls extending inwardly from said lower ends of said side walls, and upper walls extending inwardly from said upper ends of said side walls with a groove running therebetween, said channel walls defining opposing slots, and the second of said frame members including a locking flange projecting toward said first frame member and having opposing lateral faces with retainer grooves formed therein, said coupler member comprising:

an elongated base having upper and lower faces and an elongate axis and dimensioned when said elongate axis of said base is aligned with said groove between said upper walls of said first frame member to be received through said groove and into said channel;

compressible ridges formed on one of said upper or lower faces of said base such that when said base is received within said channel in said first frame member and rotated to position said elongate axis of said base transversely to said channel, said ridges bear against the corresponding upper or lower channel walls and force the opposite face of said base snugly against the other of said upper or lower channel walls, compressing said ridges and maintaining said base within said channel;

a pair of resilient legs projecting upwardly from said base in spaced-apart relation for receiving said locking flange therebetween; and flanges formed on mutually facing portions of said legs and dimensioned to be received within said retainer grooves on said opposing lateral faces of said locking flange on said second frame member, whereby when said base of said coupler member is secured within said channel of said first member, said legs of said coupler member engage said retainer grooves of said locking flange on said second frame member to secure said frame members together.

21. The coupler member of claim 20, wherein said ends of said legs opposite said base comprise wedging surfaces such that as said locking flange is received between said legs said wedging surfaces engage the adjacent edge of said locking flange and force said legs outwardly to either side of said locking flange, said legs resiling inwardly as said flanges engage said retainer grooves, whereby said flanges are maintained firmly within said grooves.

22. A framing system for storefronts and the like, comprising:

a first frame member having a locking channel formed thereon;

a second frame member in parallel spaced-apart relation to said first frame member;

a locking flange projecting from said second frame member, said locking flange having opposing lateral faces defining a plurality of sets of retainer grooves therein;

a coupler member twist-lockable at one end thereof into said locking channel of said first frame member, the other end of said coupler member comprising a pair of resilient legs in parallel spaced-apart relation, said legs having flanges formed on mutually facing portions thereof, said locking flange projecting from said second frame member being receivable between said pair of resilient legs such that said flanges on said mutually facing portions of said legs snap into engagement with one of said sets of retainer grooves formed on said lateral faces of said locking flange, whereby said coupler member secures said first and second frame members together in parallel spaced-apart relation, and whereby said spaced-apart relation between said frame members can be controlled by selecting the set of retainer grooves which said flanges on said mutually facing portions of said legs engage.

23. A framing system for storefronts and the like, comprising:

a first frame member;

a second frame member in parallel spaced-apart relation to said first frame member;

first and second locking channels formed on mutually facing portions of said first and second frame members, said second locking channel defining a plurality of sets of opposing slots;

a coupler member twist-lockable at one end thereof into said first locking channel on said first frame member, the other end of said coupler member comprising a pair of resilient legs in parallel spaced-apart relation, said legs having flanges formed on outer portions thereof, said pair of resilient legs being receivable into said second locking channel such that said flanges on said outer portions of said legs snap into engagement with one of said plurality of sets of opposing slots to lock said coupler member into said second locking channel;

whereby said coupler member secures said first and second frame members together in parallel spaced-apart relation; and whereby said spaced-apart relation between said frame members can be controlled by selecting the set of opposing slots which said flanges on said outer portions of said legs engage.

* * * * *